United States Patent [19]

Ellgass

[11] Patent Number: 4,755,089

[45] Date of Patent: Jul. 5, 1988

[54] VEHICLE ADAPTED TO FACILITATE THE LOADING AND UNLOADING OF OBJECTS

[76] Inventor: Louis P. Ellgass, Chemin de Vy-Neuve 12, CH-1470 Estavayer-le-Lac, Switzerland

[21] Appl. No.: 16,249

[22] Filed: Feb. 19, 1987

[30] Foreign Application Priority Data

Feb. 21, 1986 [CH] Switzerland ..... 693/86

[51] Int. Cl.[4] ..... B60P 3/00

[52] U.S. Cl. ..... 410/67; 280/79.1 A; 414/498

[58] Field of Search ..... 410/67, 66, 4, 7, 8, 410/32, 46; 414/498, 679, 507; 280/79.1 R, 79.1 A

[56] References Cited

U.S. PATENT DOCUMENTS

| | | | |
|---|---|---|---|
| 1,529,223 | 3/1924 | Stoll | 410/67 |
| 2,172,154 | 9/1939 | Perin | 410/66 |
| 3,445,013 | 5/1969 | Scheinert | 410/67 |
| 4,056,066 | 11/1977 | Homanick | 410/66 |

FOREIGN PATENT DOCUMENTS

| | | |
|---|---|---|
| 12705 | 6/1980 | European Pat. Off. . |
| 2037010 | 12/1970 | France . |
| 2264683 | 10/1975 | France . |
| 468894 | 10/1967 | Switzerland . |
| 847792 | 9/1960 | United Kingdom . |

*Primary Examiner*—Robert R. Song

*Attorney, Agent, or Firm*—Willian Brinks Olds Hofer Gilson & Lione Ltd.

[57] ABSTRACT

A vehicle is disclosed having a chassis supporting a platform having a network of criss-cross guiding rails. Trolleys circulate along these rails so as to be selectively movable towards the rear of the vehicle for the loading and unloading of road signs. The trolleys are provided with a braking device to enable them to be immobilized on the rails. The vehicle may be a trailer for the transportation of road signs, for example to indicate road works on streets and expressways.

9 Claims, 7 Drawing Sheets

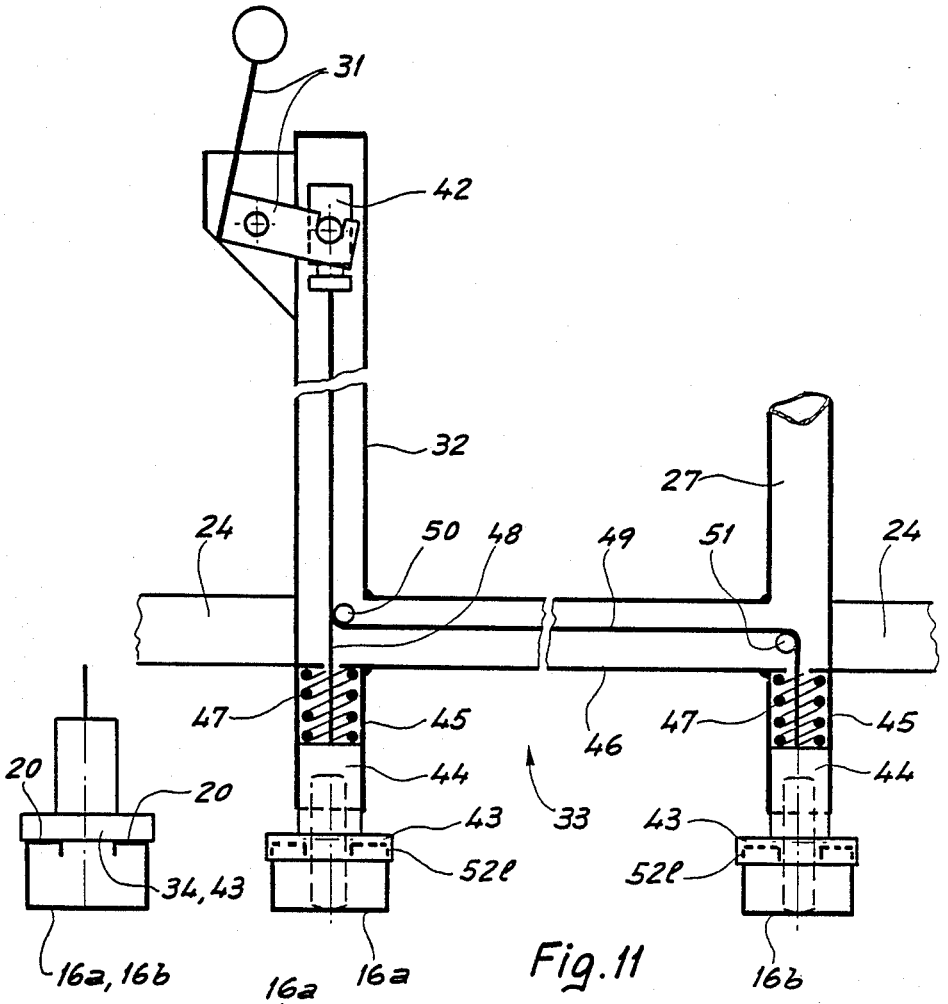
Fig.11
Fig.13
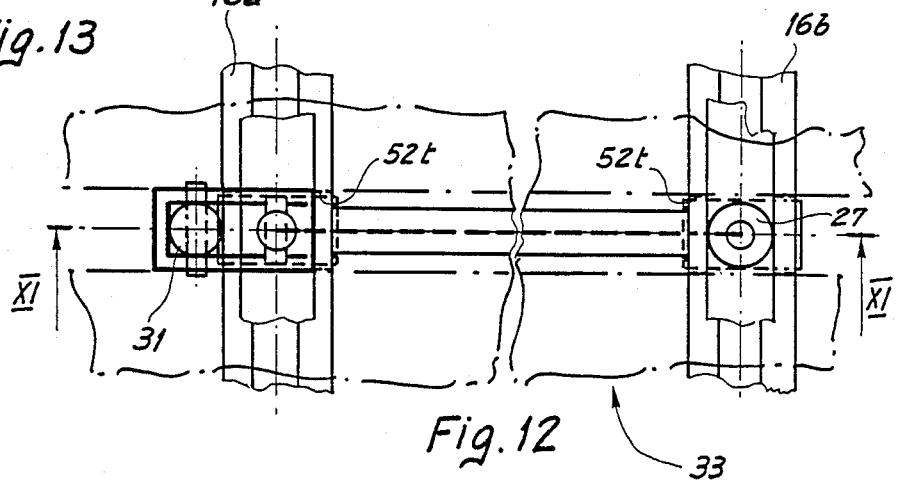
Fig.12

VEHICLE ADAPTED TO FACILITATE THE LOADING AND UNLOADING OF OBJECTS

BACKGROUND OF THE INVENTION INCLUDING THE OBJECTS

The instant invention relates to vehicles having means permitting manual loading and unloading under conditions that are convenient and safe.

In order to make it possible to load and unload a vehicle under favourable safety conditions it is often desirable for all the objects to be capable of being placed on the loading platform or of being removed therefrom in such a way that the person entrusted with this activity is able to remain on one side of the vehicle only.

Examples of such vehicles are those which are used on highways and other major traffic arteries such as expressway for carrying road signs used during the setting up of road works. The placing of such signs has to be effected before the traffic has slowed down, with the result that vehicles needing to be unloaded on the left hand side of the latter (assuming that traffic normally drives on the right) expose the workers to very great accident risks. It should be noted that it is generally impossible to unload on the right on highways due to the metal safety barrier which usually borders such roads, assuming the vehicle generally drives along the emergency lane thereof.

On average, for a typical repair site, a minimum of about twenty-five signs are needed, which it would be difficult to load one next to the other in order to enable them to be unloaded directly from the back of the vehicle since, under such conditions, the latter would have to be prohibitively wide. A solution of this kind is proposed in French application No. 2 037 010. Moreover, in this case the signs must be of a specific type and placed on edge in slides fitted to the top and bottom of the trailer. There is a limit to the thickness of the signs and it is in particular impossible to provide traffic lights mounted on the signs. Moreover, in order to load or unload, the signs have to be manipulated in order to place them upright or on edge. It is also possible to arrange two rows on the base of the vehicle, namely one row in front and one behind, the front row then having to be unloaded from the side and the back row from the back of the vehicle. The above-mentioned risk is thus also present with this earlier proposal.

French application No. 2 264 683 discloses a trailer in which the signs are arranged side by side in channels which may be unloaded from the rear. Each channel contains various signs with the result that, in order to unload a sign located at the front it is first of all necessary to unload the one behind it which is at the back. This renders it necessary to load up in a specific order, which makes things additionally complicated for the workers.

Another solution is described in European application No. 0 012 705 which related to a vehicle on the loading platform of which is mounted a bracket having crossed arms on which the signs are suspended in mutually perpendicular positions.

Thus, in the case of the above-mentioned French application No. 2 264 683 the safety of the personnel is ensured since all the signs are unloaded from the rear, but this does not apply in the case of the vehicle disclosed in European application No. 0 012 705 with regard to the unloading of signs suspended on the arm of the bracket which extends in a direction transverse to the vehicle.

It is an object of the instant invention to provide a transportation vehicle for objects capable of being loaded or unloaded on one side of the vehicle only, allowing for the necessary conditions of safety and convenience, notably in its application to a transportation vehicle for road signs.

It is a further object of the instant invention to provide a transportation vehicle for objects wherein the loading height is the same for all the signs.

It is a further object of the instant invention to provide a transportation vehicle for objects wherein the signs are arranged in an upright position.

It is a further object of the invention to provide a transportation vehicle wherein the trolleys can be removed from and replaced on the trailer with the aid of a lever device when they are laden with signs; whereby a trailer may thus be very rapidly prepared for a given site.

It is a further object of the instant invention to provide a transportation vehicle for objects wherein it is possible to accommodate all types of signs in current use, including their folding support stands.

It is a further object of the instant invention to provide a transportation vehicle for objects wherein the racks may be sufficiently wide to take signs incorporating flashing signs and/or traffic lights.

DESCRIPTION OF THE INVENTION

The invention thus provides a vehicle for carrying objects comprising a chassis having a horizontal base mounted on wheels, including:

a network of guide rails crossing each other at right angles and defining on said base $m \times n$ fields, and a plurality of trolleys capable of being moved along said rails and so adapted as to be able to accommodate said objects, and in that m being the number of fields situated along the edge of the vehicle on which said objects must be loaded or unloaded, the number of trolleys being at most equal to $m \times n - 1$, m and n being whole numbers greater than 1, in such as way that an adequate interchange of said trolleys between said fields facilitates the loading or unloading of all the objects on said edge having m fields.

Thus, the trolleys may be moved one by one near to the edge of the base of the vehicle on which the operation of loading or unloading the objects may be carried out as effectively as possible.

In the case specifically mentioned hereinabove of a transportation vehicle for road signs, the side having m fields will thus be at the back of the vehicle, the opposite side (which naturally also has m fields) being, for obvious reasons, unusable for loading or unloading purposes. Indeed, if the vehicle is motorized, this front edge of the platform adjoins the cabin, whereas if the vehicle is a trailer the operation in question will be hampered on this front edge by the presence of the coupling (towing bracket).

Nevertheless, in other applications such as in the case of a delivery truok for example, it may be useful to have the side having m fields on the base extending along the lateral sides of the vehicle, whereby loading or unloading could be carried out according to circumstances, either on one or other of the longitudinal sides of the truck.

BRIEF DESCRIPTION OF THE DRAWINGS

The invention will be better understood through study of the following description, in its application to a trailer for the transportation of road signs.

In the enclosed drawings, which are intended solely by way of example to describe a single embodiment of the invention:

FIG. 11 is a partial elevation in section of a braking mechanism of a transversely moving trolley;

FIG. 12 is a plan view of the braking mechanism of FIG. 11;

FIG. 13 is a schematic view of a trolley brake shoe acting on the upper surface of a rail;

Figure 1:
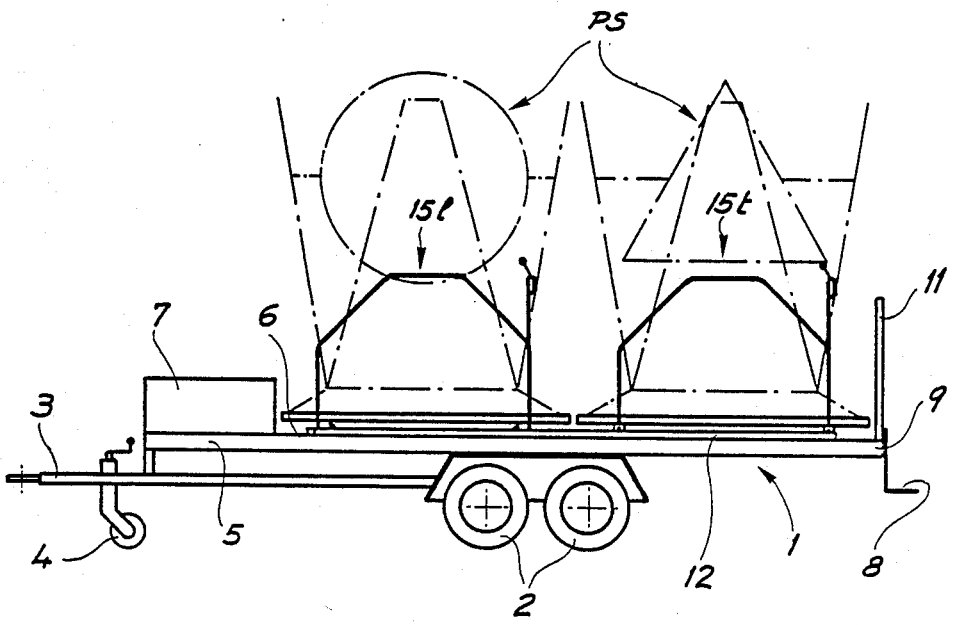
FIG. 1 shows a lateral elevation of a trailer of the invention.
Figure 2:
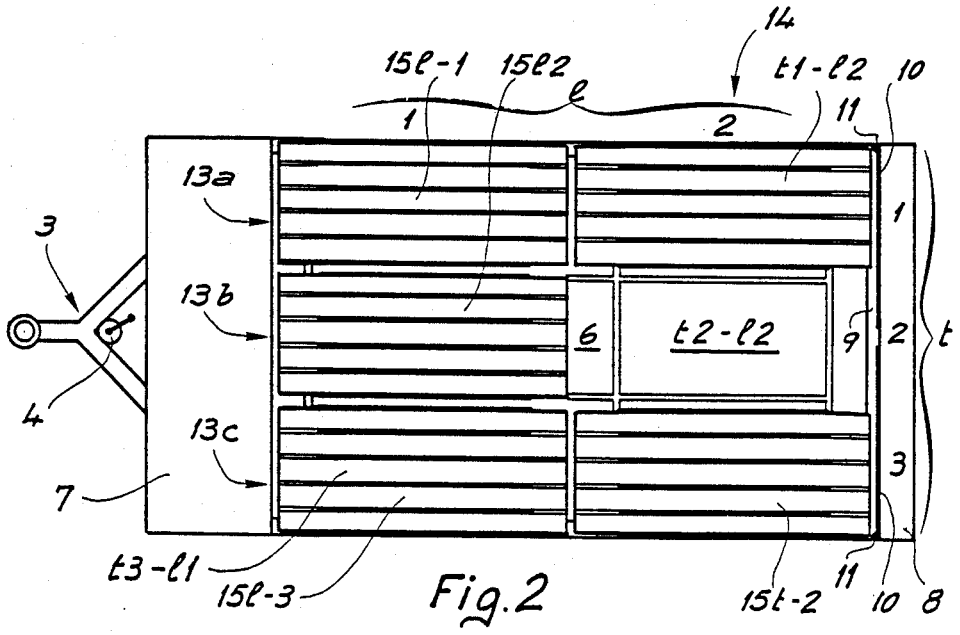
FIG. 2 is a plan view of the trailer of FIG. 1.
Figure 3:
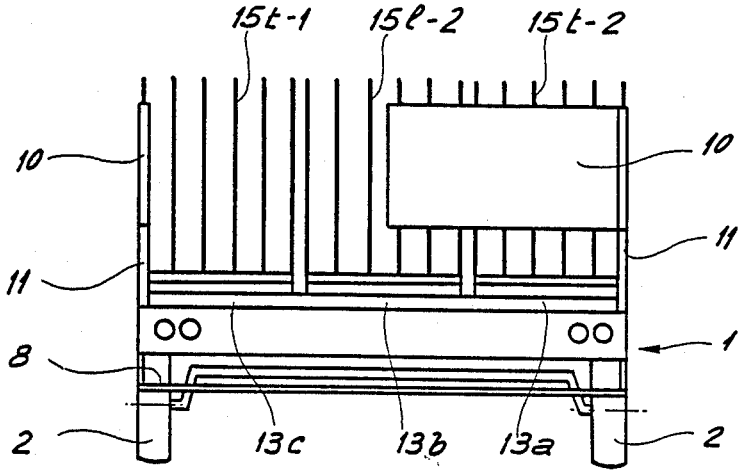
FIG. 3 shows a rear view elevation of the trailer.

From FIGS. 1 to 3 it may be seen that the vehicle described for the purposes of illustrating the invention is a road trailer comprising a chassis 1, mounted on two axles equipped with wheels 2, and capable of being pulled by a motor vehicle (not shown) by means of a coupling 3. This latter is provided with a parking wheel 4. The chassis 1 may be constructed in a conventional manner. This chassis has in particular a base 5 having a loading platform 6. At the front of this platform there may be provided a box 7 for the storage of tools and accessories required in conjunction with the signs, such as flashing lights (traffic lights), cones for marking the boundaries of the traffic lane, etc.

The chassis is provided with a foot-plate 8 at its rear edge 9 and is closed along the length of this edge by two barriers 10 mounted in articulated manner on pegs 11 and capable of being locked in their open or closed position. In FIG. 3, the trailer is shown with the left barrier 10 open, the right one being closed.

A network 12 of transport rails (see also FIG. 4) is mounted on the platform 5 of the chassis 1. These transport rails cross each other at right angles and are four in number in the embodiment shown. Those extending longitudinally are numbered 13*a*, 13*b* and 13*c*, whilst that which extends transversely has the number 14. Thus, in this example, the network comprises six fields designated by their coordinates along the transverse edges t and the longitudinal edges l of the platform. For example, the front left field is designated by $t_3-l_1$ and that located at the back right by $t_1-l_2$(see FIG. 2).

Trolleys 15 carrying objects (in this case the road signs RS shown in FIG. 1) are able to move on the network 12 of transport rails. If this network comprises $m \times n$ fields, m being the number of fields in the transverse direction t and n the number of fields in the longitudinal direction l, the number of trolleys is equal to $m \times n-1$. In the present example, $m=3$ and $n=2$.

One characteristic of the trailer which is the specific embodiment of the invention described herein is that the trolleys are only able to move in one direction, thus notably simplifying the construction of the network 12 and hence reducing the cost of the trailer. Thus, as shown in FIG. 2, trolleys 15*l* - 1, 15*l* - 2 and 15*l* - 3 can only move longitudinally whereas the trolleys 15*t* - 1 and 15*t* - 2 are only designed for transverse movement. This has the result that all the trolleys may be unloaded from the rear edge 9 of the trolley.

It is obvious that the invention is not limited to the details of the actual embodiment described. In a further embodiment of the invention the transport rails and trolleys may be so equipped that it would be possible to move the trolleys in two perpendicular directions, which makes it possible to bring each trolley in a set of trolleys travelling on a network having any number of rails to any field whatsoever on the vehicle platform. A configuration of this kind could, for example, be useful for a delivery truck or railway waggon and would make it possible to unload the platform as desired from any edge thereof (see also FIGS. 15A, 15B and 15C).

Figure 5:
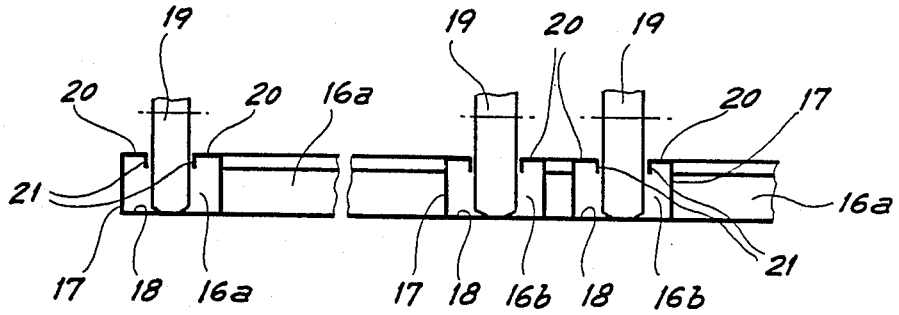
FIG. 5 is a large scale view and a vertical transverse section through a transport rail of the network.
Figure 6:
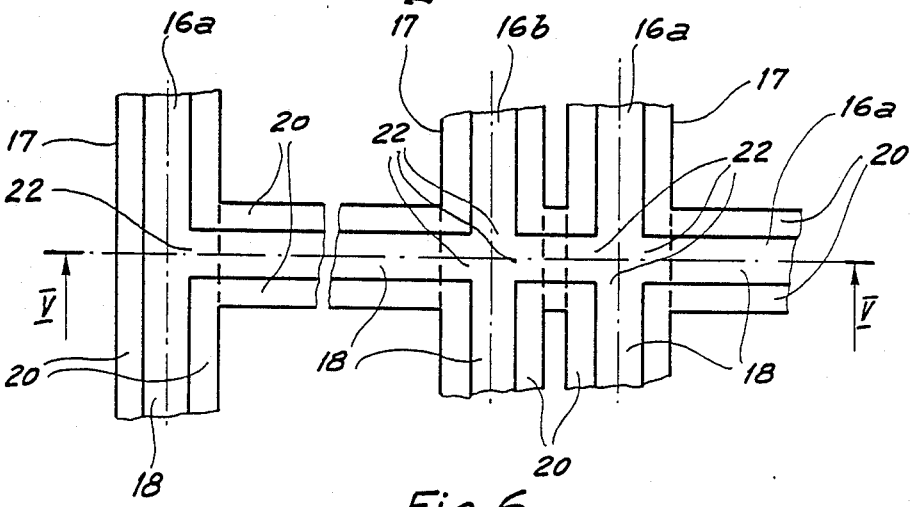
FIG. 6 is a partial plan view of the rail shown in section in FIG. 5 and its crossing with a rail in the other direction perpendicular to the first.
Figure 4:
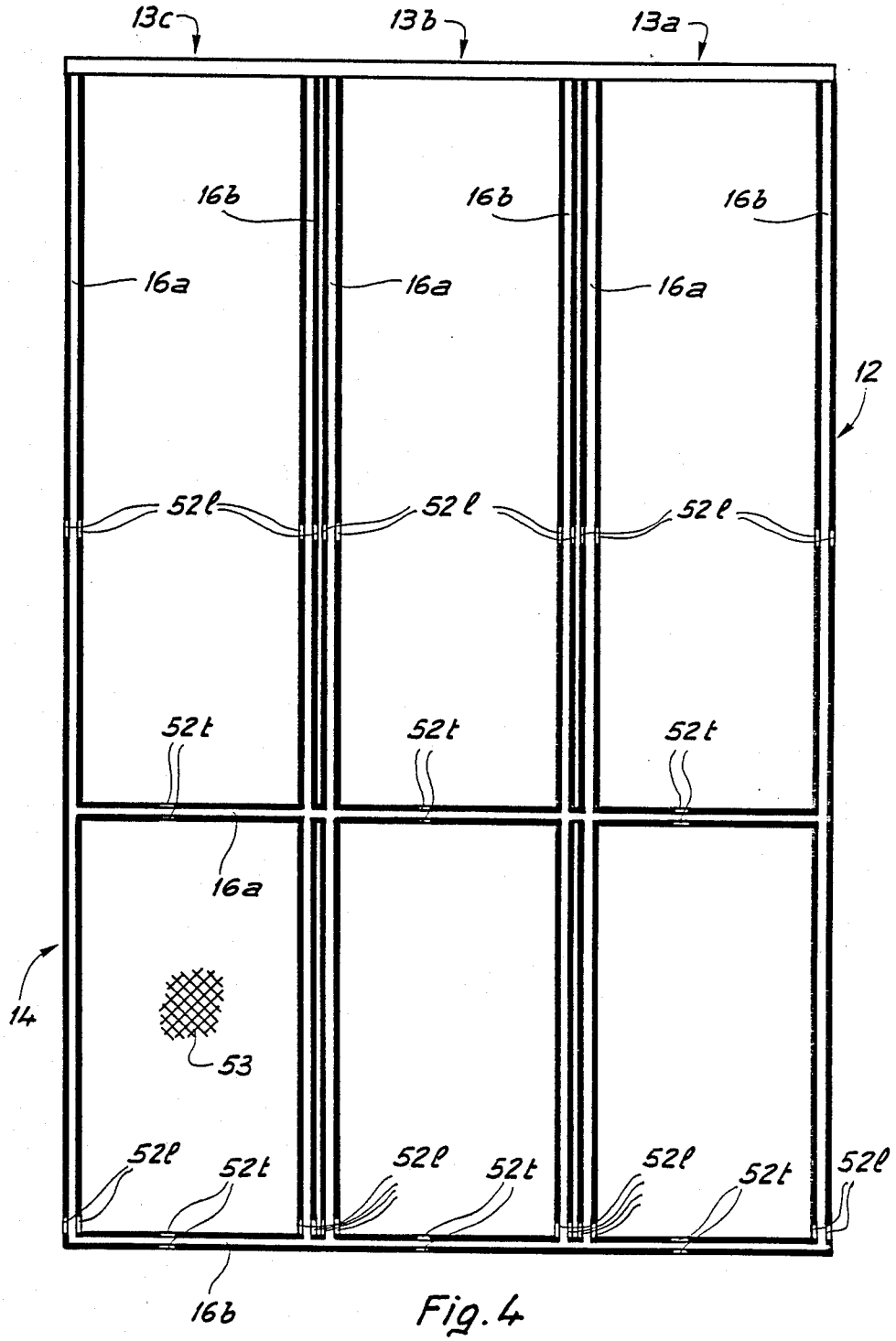
FIG. 4 is a schematic plan view of a network of transport rails mounted on the base of a trailer.

Reference will now be made to FIGS. 4, 5 and 6 which show the construction of the network 12 of the transport rails in greater detail.

Each rail 13*a* to 13*c* and 14 comprises two parallel rails 16*a* and 16*b* which, as shown in particular in FIGS. 5 and 6, are comprised of profiles 17 having a C-shaped section the back of which rests flat on the platform 5. It is the inside face of the back of the profiles 17 which constitutes the running track 18 defined by each rail 16*a* or 16*b*.

Single running wheels 19 having a cylindrical running surface and made, for example, from a plastics material, may thus be used for the trolleys 15. These running wheels are guided laterally by the two upper lips 20 of the profiles 17 which each have an edge 21 which is bent downwards to improve running still further. At those points where the rails cross the lateral walls of the profiles 17, slots 22 are provided. The network 12 is assembled by welding the profiles 17 to one another and to the chassis 1 after each of the sections used has been cut into the appropriate length.

Figure 7:
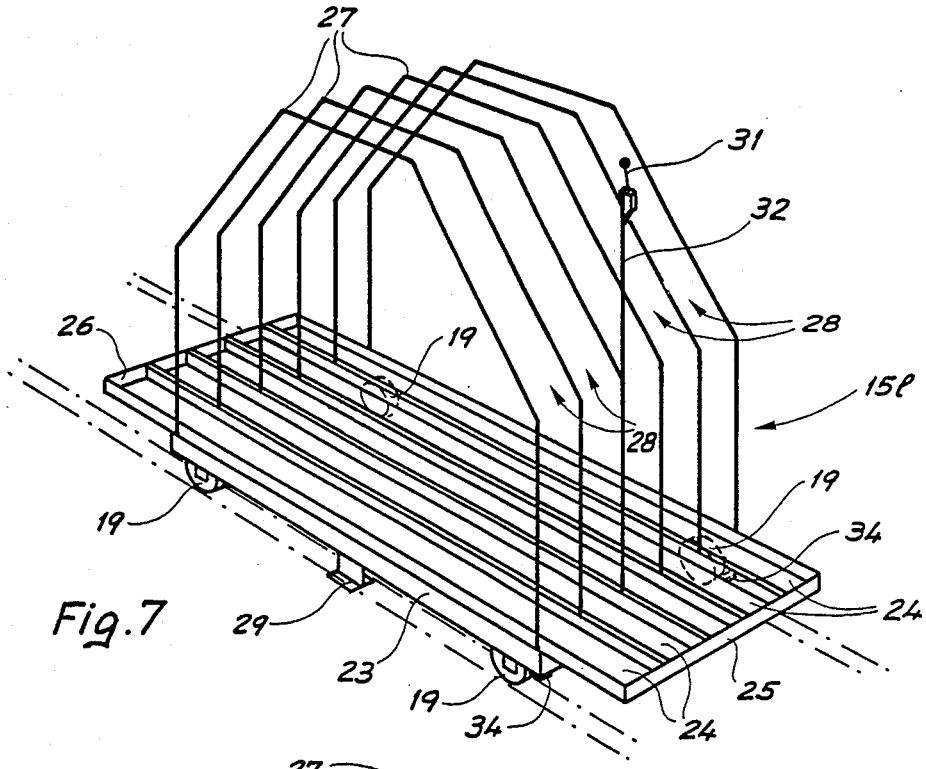
FIG. 7 is a schematic perspective view of a longitudinally moving trolley.

FIG. 7 shows a schematic perspective view of one of the longitudinal trolleys 15*l*. This latter has a frame 23 mounted on rolling means 19. Fixed to this frame are troughs 24 formed by U-profiles, the concavity of which faces upwards. These troughs 24, of which there are five, are disposed parallel to one another in a longitudinal direction and closed at their extremities by stop plates 25 and 26. Between the troughs 24 and on each side of the trolley are fixed arches 27 composed of circular section tubes which delimit between them and with the troughs 24 storage racks 28 for the road signs RS (not shown in FIG. 7). These latter are retained both laterally and longitudinally by arches 27 and by the stop plates 25 and 26 respectively.

Retaining members 29 are fixed on both sides underneath the frame 23. These members are shaped like an inverted T, their horizontal part being engaged below the lips 20 of rails 16*a* and 16*b* respectively in order to prevent the trolley from coming off the rails.

In addition, the trolley is provided with a braking and arresting means 30 which will be described hereafter and of which there is visible in FIG. 7 the control lever 31 mounted at the end of a vertical member 32 which forms part of one of the arches 27 of the trolley.

Figure 8:
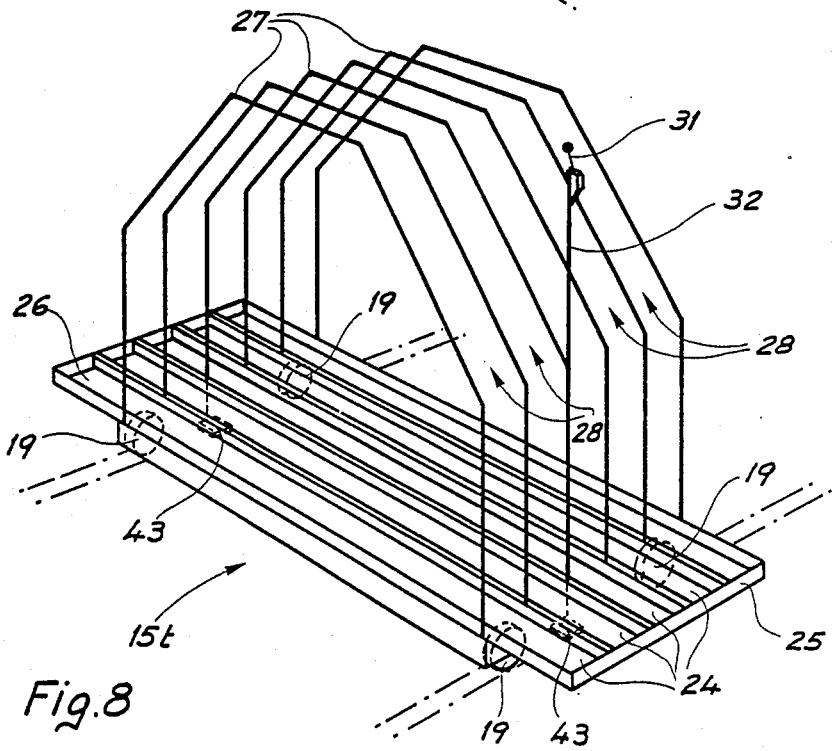
FIG. 8 is a schematic perspective view of a transversely moving trolley.

It may be seen in FIG. 8 that the trolleys 15*t* have substantially the same shape as the trolleys 15*l*. They do, however, differ in two ways, namely in the orientation of the rolling means of the trolleys 15 and also by the fitting of its braking means 33 (FIG. 11 and 12.). Nevertheless, as in the case of trolley 15*l*, this one has a pole 32 at the upper extremity of which there is provided a control lever 31.

Figure 9:
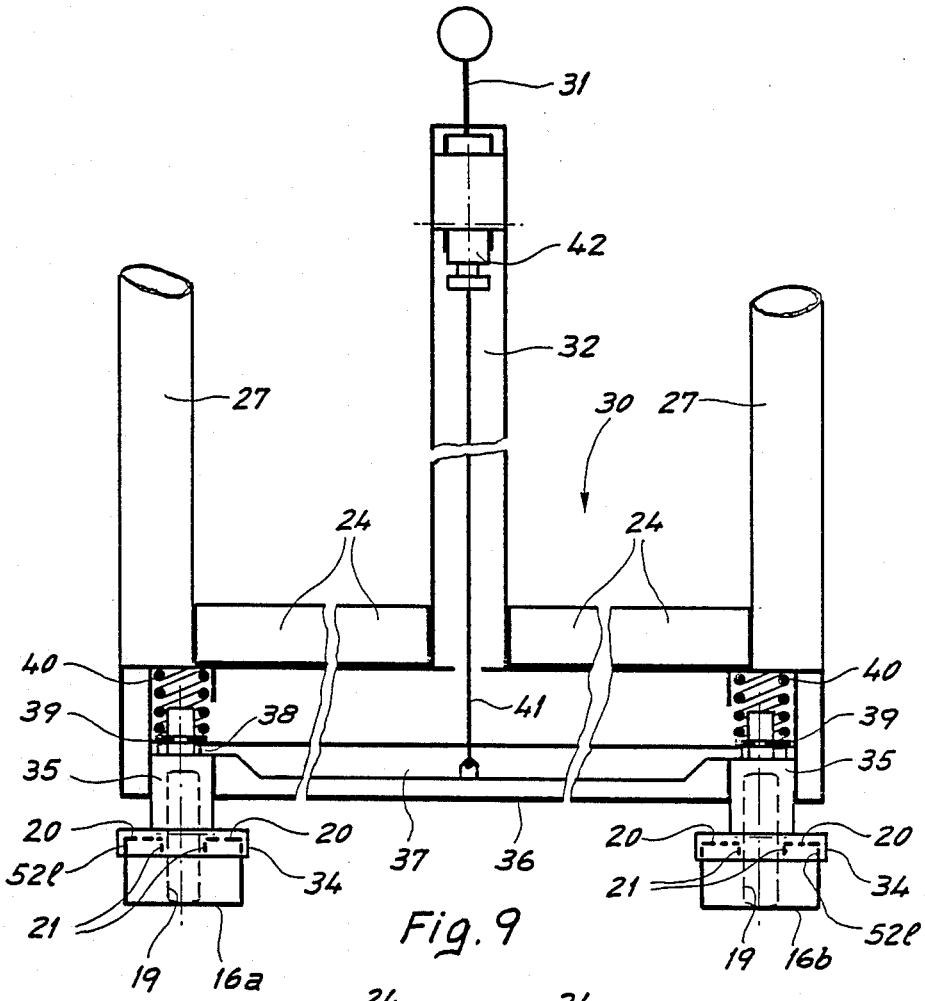
FIG. 9 shows a partial elevation in section of a braking mechanism of a longitudinally moving trolley.
Figure 10:
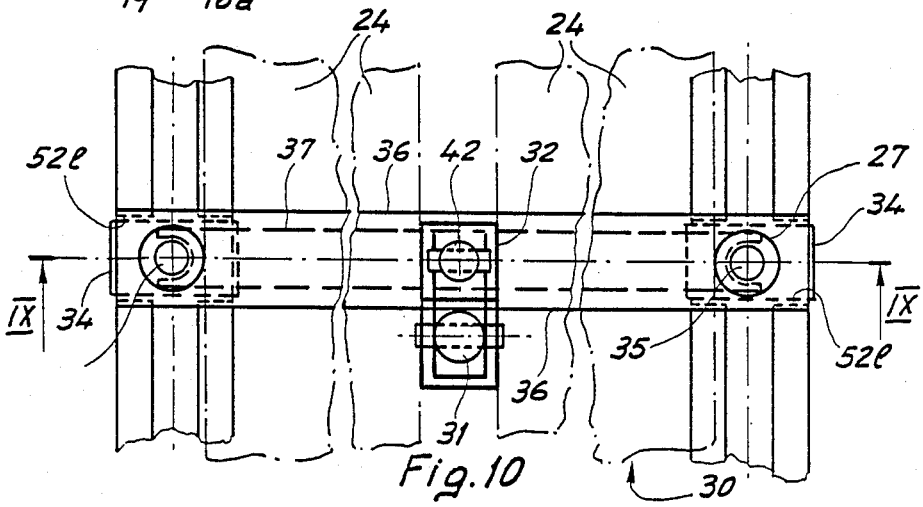
FIG. 10 is a plan view of the braking mechanism of FIG. 9.

FIGS. 9 and 10 show a schematic representation of the braking means 30 of the longitudinal trolleys 15*l*. This means is disposed transversely under the trolley perpendicular to the control lever 31. It comprises two brake shoes 34 fixed on corresponding blocks 35 mounted in a sliding manner in a vertical direction in a transverse girder 36 of the frame 23.

An operating crossbeam 37 is horizontally mounted in girder 36. This crossbeam has forked extremities which are respectively engaged in the blocks 35. These latter have a generally cylindrical shape and each comprise one part of larger diameter to which is fixed the brake shoe 34 and one part of smaller diameter which thus forms with the other part a shoulder 38 against which the crossbeam 37 rests. A retaining washer is engaged on the part of smaller diameter and is further supported in the girder 36.

A cable is attached to the crossbeam 37 and passes through the vertical member 32 which is of square transverse section. This cable is held in a channel 42 mounted so as to move vertically in the upper part of the vertical member 32 (see also FIG. 11). This channel 42 interacts with the lever 31 which is bent and which is mounted in articulated manner in a console alongside the vertical member 32.

The braking means 33 of the transverse trolleys 15*t* is shown in FIGS. 11 and 12. It has brake shoes 43 fixed on blocks 44 which are mounted in a sliding manner in end pieces 45 which form extensions of the vertical member 32 and the opposite extremity of the arch 27 which is associated with said vertical member respectively. (In Fig. 8 this arch is the third from the left). A girder 46 is fixed longitudinally in the frame 23 of trolley 15*t*. The blocks 44 are acted upon in a downwards direction by compressed springs 47 mounted in the end pieces 45. Cables 48 and 49 are attached to blocks 44 and to the channel 42 mounted above the vertical member 32 respectively. The cable 48 extends straight downwards vertically through the latter, whereas cable 49 enters this vertical member and then passes over a first pulley 50, through the girder 46 and over a second pulley 51, terminating at the other block 44.

FIGS. 9 to 12 show that the width of the brake shoes 34 and 43 exceeds that of rails 16*a* and 16*b*. These shoes are permanently urged towards their braking and/or arresting position by means of the springs associated therewith and can only be inactivated or freed on actuation of the levers 31. In order to act as arresting means, shoes 34 and 43 cooperate with the slots, 52*l* and 52*t* respectively, provided in rails 16*a* and 16*b* to arrest the relevant trolleys in their position for transportation. These slots are shown in FIGS. 4 and 9 to 12. When the lower extremities of the shoes 34 and 43 are lowered into these slots they occupy their lower arresting position.

On the other hand, as shown in FIG. 13, the shoes can exert their braking function whatever the position of trolleys 15*l* and 15*t* apart from their road position by pressing on the upper surfaces of the lips 20 of rails 16*a* and 16*b*, unless, of course, the control lever 31 of the trolley which it is desired to move, be actuated during loading or unloading of the trolleys.

FIG. 4 shows that it is possible to arrange walkways 53 between the transport rails to enable the operator to walk on the loading platform 6 and thus have access to the trolleys located at the front.

The vehicle, i.e. the trailer for the transportation of road signs according to the instant invention has the following advantages:

the loading height is the same for all the signs;

the signs are arranged in an upright position;

the trolleys can be removed from and replaced on the trailer with the aid of a lever device when they are laden with signs; a trailer may thus be very rapidly prepared for a given site;

the racks 28 are able to accommodate all types of signs in current use, including their folding support stands;

the racks 28 may be sufficiently wide to take signs incorporating flashing signs and/or traffic lights.

Figure 14:
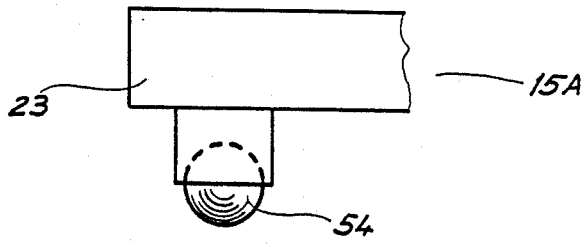
FIG. 14 shows rolling means for the trolleys enabling their selective movement along directions perpendicular to each other.

FIG. 14 shows a variant of rolling means for the trolleys. Here, the chassis 23 of a trolley 15A, partially shown, is provided with spherical rolling members 54 making it possible to selectively move the trolley on the perpendicular transport rails. For example, a trolley so equipped could move in the directions l and t as shown in FIG. 2.

Figure 15A:
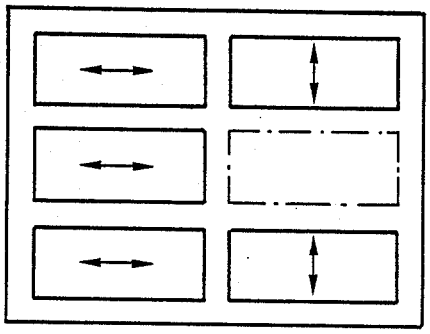
FIGS. 15A, 15B and 15C are diagrams illustrating various possibilities of arranging a transportation vehicle according to the invention.
Figure 15B:
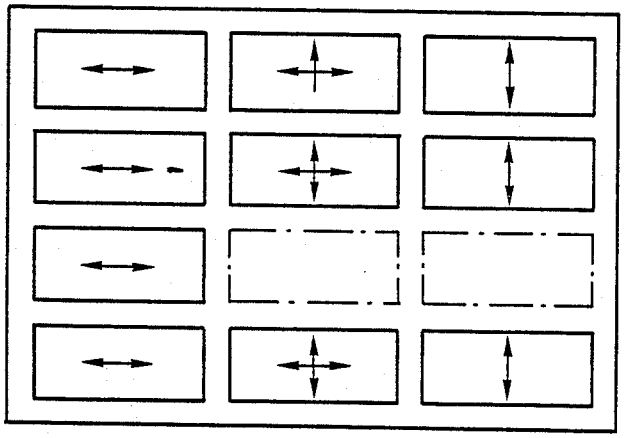
Figure 15C:
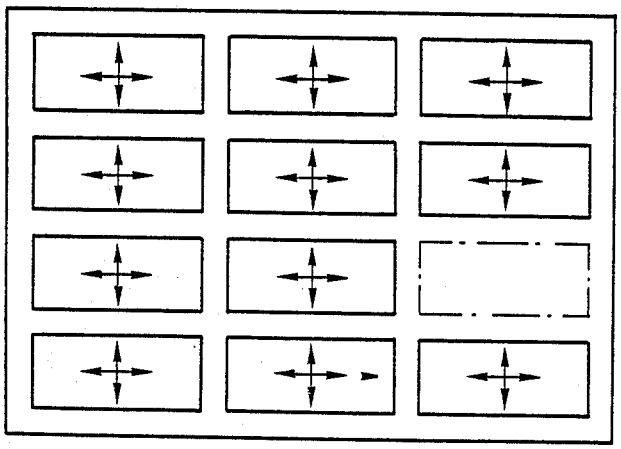

FIGS. 15A, 15B and 15C show three possible ways of arranging a vehicle according to the instant invention. The first is the solution which has been described in detail hereinabove. In this case the trolleys thus have a single characteristic direction of movement indicated by the arrows. In the second case, some trolleys are manipulated according to the principle shown in FIG. 15A and thus have running wheels. Other trolleys are provided with rolling means as shown in FIG. 14. Finally, the third instance corresponds to a vehicle having trolleys all of which have rolling means as shown in FIG. 14. It is thus possible to bring each trolley to any desired field on the platform by means of successive interchange movements. The operator may thus, in this case, choose the loading or unloading edge according to circumstances.

What is claimed is:

1. A vehicle for carrying objects comprising a chassis, a substantially horizontal base and wheels, the horizontal base surmounting the chassis and the chassis running on the wheels, said horizontal base being equipped with a network of guide rails crossing each other at substantially right angles and defining on said base $m \times n$ fields, and a plurality of trolleys capable of being moved along said guide rails and so disposed as to receive said objects, and that, m being the number of fields located along the length of the edge of the vehicle on which said objects have to be loaded or unloaded, the number of trolleys is, at most, $m \times n - 1$, m and n being whole numbers greater than 1, in such a way that adequate interchange of said trolleys between said fields facilitates the loading or unloading of all the objects on said edge having m fields.

2. A vehicle as claimed in claim 1, wherein the trolleys are provided with rolling means enabling them to be moved selectively along all the guide rails.

3. A vehicle according to claim 1, wherein certain of the said trolleys are provided with first rolling means enabling them to move solely on those guide rails extending in a first given direction whilst other trolleys are provided with second rolling means extending in a direction perpendicular to the first rolling means to enable these trolleys to move solely on those guide rails having a second direction which is perpendicular to the said direction.

4. A vehicle according to claims 1 to 3, wherein each of said guide rails is composed of two parallel rails permanently mounted at a specified distance one from the other on the horizontal base.

5. A vehicle according to claim 4, wherein each guide rail is formed of a C-shaped profile, the back of which rests flat on the base, the inner side of the back of said profile constituting the running surface of said rail.

6. A vehicle according to claim 3, wherein said rolling means are rolling wheels having a cylindrical rolling surface mounted rotateably on a frame forming the chassis of a trolley, said rolling wheels being guided by the lips of the profile of each corresponding rail.

7. A vehicle according to claim 1, wherein each trolley is equipped with a braking/arresting means said means being adapted for manual operation and acting on said guide rails.

8. A vehicle according to claim 5, wherein each braking/arresting means has shoes adapted to be urged downwards in an elastic manner to be forced against the upper lips of the rails so as to brake the trolley and to penetrate into slots disposed in the rails to arrest the trolley.

9. A vehicle according to claim 1, wherein the objects are road signs, the edge having m fields is the rear edge of the vehicle and in that there are disposed on each trolley, racks which extend in a longitudinal direction to the vehicle and which are adapted to receive said road signs.

* * * * *